US007004211B2

(12) United States Patent
Lothe

(10) Patent No.: US 7,004,211 B2
(45) Date of Patent: Feb. 28, 2006

(54) METHOD AND DEVICE FOR REDUCING THE SEPARATION OF VOLATILE ORGANIC COMPOUNDS FROM OIL DURING FILLING OF TANKS

(75) Inventor: Per Lothe, Førresfjorden (NO)

(73) Assignee: Knutsen OAS Shipping AS, (NO)

( * ) Notice: Subject to any disclaimer, the term of this patent is extended or adjusted under 35 U.S.C. 154(b) by 0 days.

(21) Appl. No.: 10/481,861

(22) PCT Filed: Jun. 24, 2002

(86) PCT No.: PCT/NO02/00227

§ 371 (c)(1),
(2), (4) Date: May 10, 2004

(87) PCT Pub. No.: WO03/002905

PCT Pub. Date: Jan. 9, 2003

(65) Prior Publication Data

US 2004/0194844 A1 Oct. 7, 2004

(30) Foreign Application Priority Data

Jun. 26, 2001 (NO) ..... 20013199

(51) Int. Cl.
*B65B 1/04* (2006.01)

(52) U.S. Cl. ..... 141/286; 141/59

(58) Field of Classification Search ..... 141/59, 141/44–48, 392, 286; 62/619, 48.2; 137/587–589
See application file for complete search history.

(56) References Cited

U.S. PATENT DOCUMENTS

| | | | | |
|---|---|---|---|---|
| 3,714,790 A * | 2/1973 | Battey | 62/48.2 |
| 4,098,303 A * | 7/1978 | Gammell | 141/52 |
| 5,176,002 A | 1/1993 | O'Brien et al. | |
| 5,429,159 A * | 7/1995 | Tees et al. | 141/59 |
| 5,860,294 A * | 1/1999 | Brendeng | 62/619 |

FOREIGN PATENT DOCUMENTS

| | | |
|---|---|---|
| DE | 19813349 | 9/1999 |
| EP | 0417004 | 3/1991 |
| NO | 19996471 | 6/2001 |
| WO | WO 99/34106 | 7/1999 |

* cited by examiner

*Primary Examiner*—Steven O. Douglas
(74) *Attorney, Agent, or Firm*—Andrus, Sceales, Starke & Sawall, LLP

(57) ABSTRACT

A method and a device for reducing the evaporation of volatile organic compounds (VOC) when an essentially liquid petroleum product is being filled into a storage and/or transport tank (16) through a drop line (14), possibly also through a loading point (8), in which a gas or mixture of gases is supplied to the upper portion of the drop line (14) or the loading point (8) during the filling operation.

16 Claims, 1 Drawing Sheet

METHOD AND DEVICE FOR REDUCING THE SEPARATION OF VOLATILE ORGANIC COMPOUNDS FROM OIL DURING FILLING OF TANKS

CROSS REFERENCE TO RELATED APPLICATION

The present application is the U.S. national stage application of International Application PCT/NO02/00227, filed Jun. 24, 2002, which international application was published on Jan. 9, 2003, as International Publication WO 03/002905. The International Application claims priority of Norwegian Patent Application 20013199, filed Jun. 26, 2001.

FIELD OF THE INVENTION

This invention relates to a method for reducing the fraction of volatile organic compounds (VOC) that separate from oil, especially from crude oil, during the filling of larger tanks, as is normal for example when a ship is being loaded from a terminal, a production platform or a floating loading device. The invention also comprises a device for practicing the method.

BACKGROUND OF THE INVENTION

Crude oil normally contains fractions of light and heavier gases which cannot be transported together with the liquid fraction of the crude oil due to their volatility. Transport-technically it would be favourable if the crude oil were separated into a gas fraction, a wet gas fraction and a liquid fraction. However, separation and transport of the petroleum products in three fractions from a production field involve considerable extra expenses, and it is therefore more common for the crude oil to be separated into a gas fraction and a liquid fraction. The wet gas phase is therefore divided into a lighter fraction which is transported together with the gas fraction, and a heavier fraction which is transported with the liquid fraction.

When a liquid petroleum fraction containing heavier gases, such as propane and butane, is being loaded at a moderate positive pressure, gages continuously evaporate from the liquid fraction. To prevent a pressure increase in the transport or storage tanks, the evaporating gases, the volatile organic compounds, must be drawn from the tanks and be carried away for combustion or they must be carried to a re-injection plant.

It is known that there is relatively extensive evaporation of volatile organic compounds as oil is being pumped into larger tanks. Normally a pressure in the order of 1.05 to 1.07 bar is maintained in both storage and transport tanks. During the loading of a tanker for example, it is common for the oil to be pumped from a storage tank through a supply pipe to a position above the cargo tank, from where the oil is directed into the tank through a drop line down to the bottom portion of the tank. A drop line of this kind may have a length in the order of several tens of metres.

When the oil enters the upper end portion of the drop line, gravity will accelerate the liquid flowing down the drop line, whereby, a lower overall pressure is created in the supply pipe and the upper portion of the drop line. In these pipes, in which there is a lower overall pressure, there is considerable evaporation of volatile organic compounds, which will be re-liquefied only to a minor extent when the pressure increases again to the normal pressure of the tank.

The invention has as its object to remedy the drawbacks of known technique.

SUMMARY OF THE INVENTION

The object is achieved, according to the invention, through the characteristics specified in the description below and in the following claims.

A preferably non-combustible gas or a mixture of gases, e.g. exhausts from a combustion process containing carbon dioxide, $CO_2$, and nitrogen, $N_2$, is pumped in sufficient amounts into the upper portion of the drop line, so as to prevent a negative pressure from occurring when oil is flowing down the drop line into the tank.

Experiments have shown that the evaporation of volatile organic compounds during loading is reduced, to a considerable extent, by preventing the creation of a negative pressure in the supply pipe and drop line. It is relatively simple to separate, in accordance with known technique the non-combustible gases from the volatile organic compounds in a subsequent separation plan, for gas flowing out of the cargo tank.

The method according to the invention is equally suitable for use during loading and unloading of ships and other larger tank facilities when oil or oil products such as gas and liquid natural gas are to be moved.

BRIEF DESCRIPTION OF THE DRAWINGS

In the following will be described a non-limiting example of a preferred method which is visualized in the accompanying drawing, in which the FIGURE shows schematically a loading arrangement, in which oil is pumped from a storage tank into a tanker.

In the drawing the reference numeral 1 identifies a storage tank for oil. A pump 2 is connected to the storage tank 1 through a pipe 4 and to the loading point 8 of a tanker 6 through a pipe 10 and a flexible connection/hose 12.

DETAILED DESCRIPTION OF THE INVENTION

Figure 1:
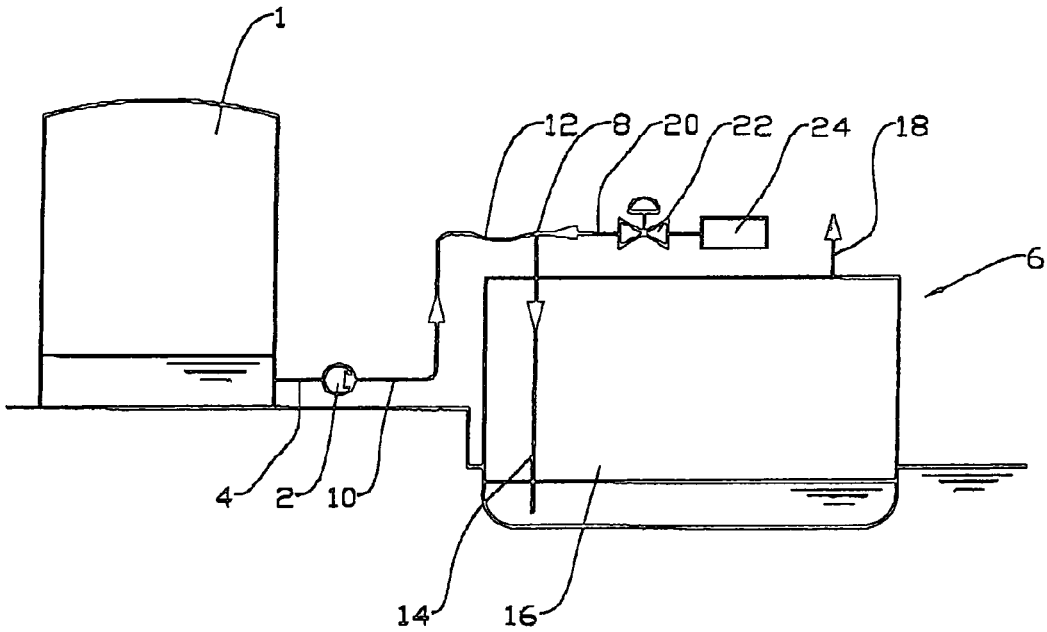

A drop line 14 extends from the loading point 8 of the tanker 6 down to the bottom portion of the cargo tank 16 of the tanker 6. A gas outlet 18 extends from the top of the cargo tank 16 to a not shown gas-treating plant.

A pipe 20 extends from the plant, not shown, for the supply of gas, for example a combustion plant 24 of a design known in itself, through a control valve 22 to the loading point 8 or the upper portion of the drop line 14.

When oil containing volatile organic compounds is pumped by the pump 2 from the storage teak 1 through the pipes 4, 10 and the hose 12 to the loading point 8 of the tanker 6, non-combustible gas is supplied at the same time through the pipe 20 by way of the valve 22 to the loading point 8 or the upper portion of the drop line 14, where it is mixed with the entering oil. The mixture of oil and non-combustible gas then flows down the drop line 14 into the cargo tank 16 of the tanker 6.

Through the supply of a suitable amount of preferably non-combustible gas to the loading point 8 or the upper portion of the drop line 14 during the loading of oil, the formation of a negative pressure in the pipes/hose 10, 12 and 14 is essentially prevented. The evaporation of volatile organic compounds during loading is thereby reduced, to a substantial degree.

What is claimed is:

1. A method for filling a tank with an essentially liquid petroleum product, the method comprising the steps of:

filling the tank with the essentially liquid petroleum product via at least one drop line; and reducing evaporation of volatile organic compounds from the petroleum product by supplying a noncombustible gas to an upper portion of the drop line during the filling operation.

2. The method of claim 1, wherein the upper portion of the drop line comprises a loading point.

3. The method of claim 2, wherein the noncombustible gas is supplied to the loading point.

4. The method of claim 1, wherein the tank is a storage tank.

5. The method of claim 1, wherein the tank is a transport tank.

6. A device for reducing the evaporation of volatile organic compounds from an essentially liquid petroleum product during filling of the essentially liquid petroleum product into a tank, the device comprising:

a tank;

a drop line interconnecting the tank and a supply of liquid petroleum product such that the tank can be filled with petroleum product; and a supply line interconnecting the drop line and a combustion plant such that the drop line can be supplied with a noncombustible gas.

7. The device of claim 6, wherein the tank is a storage tank.

8. The device of claim 6, wherein the tank is a transport tank.

9. The device of claim 6, wherein the drop line comprises a loading point and the supply line is connected to the loading point.

10. A method for filling a tank with an essentially liquid petroleum product, the method comprising the steps of:

filling the tank with the essentially liquid petroleum product via a drop line that extends from an upper portion to a lower portion that is in the tank, wherein the upper portion is higher than the lower portion;

reducing evaporation of volatile organic compounds from the petroleum product by supplying a noncombustible gas to the upper portion of the drop line during the filling operation to prevent a negative pressure from occurring when the liquid petroleum product flows down the drop line and into the tank.

11. The method of claim 10, wherein the upper portion of the drop line comprises a loading point.

12. The method of claim 11, wherein the noncombustible gas is supplied to the loading point.

13. The method of claim 10, wherein the tank is a storage tank.

14. The method of claim 10, wherein the tank is a transport tank.

15. The method of claim 10, wherein the noncombustible gas comprises carbon dioxide.

16. The method of claim 10, wherein the noncombustible gas comprises nitrogen.

* * * * *